US010118782B2

(12) United States Patent
Wakakusa

(10) Patent No.: US 10,118,782 B2
(45) Date of Patent: Nov. 6, 2018

(54) SHEET FEEDER, IMAGE RECORDING APPARATUS HAVING THE SHEET FEEDER, AND COMPUTER-READABLE MEDIUM THEREFOR

(71) Applicant: BROTHER KOGYO KABUSHIKI KAISHA, Nagoya, Aichi (JP)

(72) Inventor: Keisuke Wakakusa, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/718,109

(22) Filed: Sep. 28, 2017

(65) Prior Publication Data

US 2018/0093498 A1 Apr. 5, 2018

(30) Foreign Application Priority Data

Sep. 30, 2016 (JP) ..... 2016-194093

(51) Int. Cl.
*B65H 7/08* (2006.01)
*B65H 7/06* (2006.01)
(Continued)

(52) U.S. Cl.
CPC ..... *B65H 7/06* (2013.01); *B41J 11/006* (2013.01); *B65H 1/04* (2013.01); *B65H 3/0684* (2013.01);
(Continued)

(58) Field of Classification Search
CPC ..... B65H 3/00; B65H 3/0669; B65H 3/0684; B65H 3/34; B65H 3/46; B65H 3/52;
(Continued)

(56) References Cited

U.S. PATENT DOCUMENTS

2009/0057987 A1* 3/2009 Matsumoto ..... B65H 3/0607 271/114
2015/0368054 A1* 12/2015 Kowase ..... B65H 7/06 271/258.01
(Continued)

FOREIGN PATENT DOCUMENTS

JP 2003-312893 A 11/2003
JP 2016-5976 A 1/2016

*Primary Examiner* — Prasad V Gokhale
(74) *Attorney, Agent, or Firm* — Scully, Scott, Murphy & Presser, PC

(57) ABSTRACT

A sheet feeder includes a controller configured to perform a driving process of supplying a motor with an electric current to rotate a roller, perform a stopping process of stopping supplying the electric current in response to determining that the motor has not rotated before a second sensor detects a sheet, when an accumulated rotational quantity of the roller is less than a threshold, set a retry upper limit to a first value, the accumulated rotational quantity being detected by a first sensor in the driving process performed for a first time, when the accumulated rotational quantity of the roller is equal to or more than the threshold, set the retry upper limit to a second value more than the first value, and repeatedly perform the driving process and the stopping process until a number of retries reaches the retry upper limit or until the second sensor detects the sheet.

13 Claims, 8 Drawing Sheets

(51) Int. Cl.

| | |
|---|---|
| ***B41J 11/00*** | (2006.01) |
| ***G03G 15/00*** | (2006.01) |
| ***B65H 1/04*** | (2006.01) |
| ***B65H 5/06*** | (2006.01) |
| ***B65H 7/18*** | (2006.01) |
| ***B65H 3/06*** | (2006.01) |
| ***B65H 3/52*** | (2006.01) |

(52) U.S. Cl.
CPC ..... *B65H 3/5223* (2013.01); *B65H 5/062* (2013.01); *B65H 7/18* (2013.01); *G03G 15/6502* (2013.01); *B65H 2511/515* (2013.01); *B65H 2553/51* (2013.01); *B65H 2553/82* (2013.01); *B65H 2701/131* (2013.01); *B65H 2801/03* (2013.01)

(58) Field of Classification Search
CPC ..... B65H 3/5215; B65H 3/5223; B65H 7/00; B65H 7/02; B65H 7/04; B65H 7/06; B65H 7/12; B65H 7/14; B65H 7/18; B65H 7/20; B65H 2511/515; B65H 2511/52; B65H 2513/512; B65H 2513/514; B65H 2553/51
See application file for complete search history.

(56) References Cited

U.S. PATENT DOCUMENTS

| | | | | |
|---|---|---|---|---|
| 2015/0368056 | A1 | 12/2015 | Murata | |
| 2016/0060057 | A1* | 3/2016 | Nobuta ..... | H02P 29/0241 74/405 |
| 2018/0072521 | A1* | 3/2018 | Okubo ..... | B65H 3/0661 |

* cited by examiner

SHEET FEEDER, IMAGE RECORDING APPARATUS HAVING THE SHEET FEEDER, AND COMPUTER-READABLE MEDIUM THEREFOR

CROSS-REFERENCE TO RELATED APPLICATION

This application claims priority under 35 U.S.C. § 119 from Japanese Patent Application No. 2016-194093 filed on Sep. 30, 2016. The entire subject matter of the application is incorporated herein by reference.

BACKGROUND

Technical Field

The following description relates to aspects of a sheet feeder, an image recording apparatus having the sheet feeder, and a computer-readable medium therefor.

Related Art

A sheet feeder has been known that is configured to detect an error state (e.g., no sheet to be fed, misfeeding, and sheet jam) in sheet feeding, based on a value of an electric current supplied to a DC motor or a rotational angle of a pickup roller. Further, another sheet feeder has been known that is configured to retry sheet feeding in response to detecting an error state in previously-retried sheet feeding.

SUMMARY

A retry to perform sheet feeding in response to occurrence of misfeeding or sheet jam is effective to eliminate the error state. Meanwhile, a retry to perform sheet feeding in response to detection of no sheet to be fed is not only ineffective but might damage a motor and/or a transmission mechanism (e.g., shafts and gears). Namely, whether a retry of sheet feeding is effective depends on a type of the error state. Further, for the former of the known sheet feeders, it is difficult to accurately detect the error state.

Aspects of the present disclosure are advantageous to provide one or more improved techniques, for a sheet feeder, which make it possible to more certainly eliminate an error in sheet feeding without damaging the sheet feeder.

According to aspects of the present disclosure, a sheet feeder is provided that includes a tray having a supporter configured to support a sheet placed on the tray, a roller disposed in a position contactable with the supporter, the roller being configured to, when rotating in a particular direction, feed the sheet supported by the supporter, in a conveyance direction along a conveyance path, a motor configured to generate a driving force to rotate the roller in the particular direction, a first sensor configured to detect a rotational quantity of the roller, a second sensor configured to detect that the sheet reaches a particular position on the conveyance path, and a controller configured to perform a particular process. The particular process includes a driving process including supplying the motor with an electric current, a stopping process including in response to determining that the motor has not rotated before the second sensor detects that the sheet reaches the particular position, stopping supplying the electric current to the motor, a setting process including when an accumulated rotational quantity of the roller is less than a threshold, setting a retry upper limit to a first value, the accumulated rotational quantity being detected by the first sensor in the driving process performed for a first time after a beginning of the particular process, the first value being equal to or more than one, and when the accumulated rotational quantity of the roller is equal to or more than the threshold, setting the retry upper limit to a second value more than the first value, and repeatedly performing the driving process and the stopping process until a number of retries to perform the driving process reaches the retry upper limit or until the second sensor detects that the sheet reaches the particular position.

According to aspects of the present disclosure, further provided is an image recording apparatus that includes the aforementioned sheet feeder, a conveyance roller disposed downstream of the particular position in the conveyance direction, the conveyance roller being configured to convey the sheet in the conveyance direction, and an image recorder disposed downstream of the conveyance roller in the conveyance direction, the image recorder being configured to record an image on the sheet. The particular process further includes in response to the second sensor detecting that the sheet reaches the particular position, controlling the conveyance roller to convey the sheet to a specific position to face the image recorder, and controlling the image recorder to record an image on the sheet conveyed by the conveyance roller to the specific position.

According to aspects of the present disclosure, further provided is a non-transitory computer-readable medium storing computer-readable instructions that are executable on a processor coupled with a sheet feeder. The sheet feeder includes a tray having a supporter configured to support a sheet placed on the tray, a roller disposed in a position contactable with the supporter, the roller being configured to, when rotating in a particular direction, feed the sheet supported by the supporter, in a conveyance direction along a conveyance path, a motor configured to generate a driving force to rotate the roller in the particular direction, a first sensor configured to detect a rotational quantity of the roller, and a second sensor configured to detect that the sheet reaches a particular position on the conveyance path. The instructions are configured to, when executed by the processor, cause the processor to perform a particular process that includes a driving process including supplying the motor with an electric current, a stopping process including in response to determining that the motor has not rotated before the second sensor detects that the sheet reaches the particular position, stopping supplying the electric current to the motor, a setting process including when an accumulated rotational quantity of the roller is less than a threshold, setting a retry upper limit to a first value, wherein the accumulated rotational quantity is detected by the first sensor in the driving process performed for a first time after a beginning of the particular process, and the first value is equal to or more than one, and when the accumulated rotational quantity of the roller is equal to or more than the threshold, setting the retry upper limit to a second value more than the first value, and repeatedly performing the driving process and the stopping process until a number of retries to perform the driving process reaches the retry upper limit or until the second sensor detects that the sheet reaches the particular position.

BRIEF DESCRIPTION OF THE ACCOMPANYING DRAWINGS

Figure 4B:
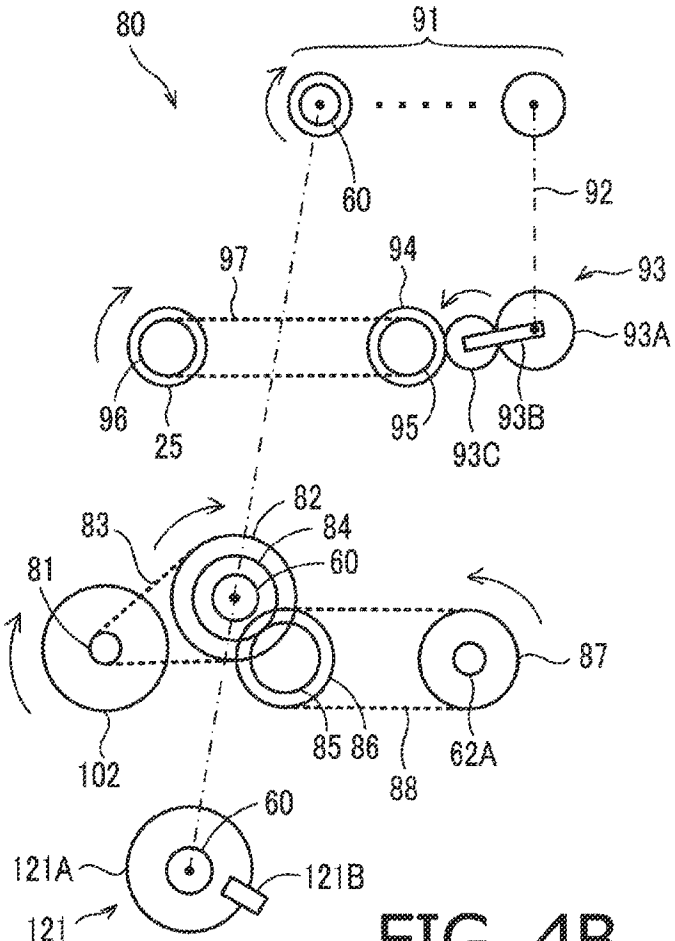
Figure 4A:
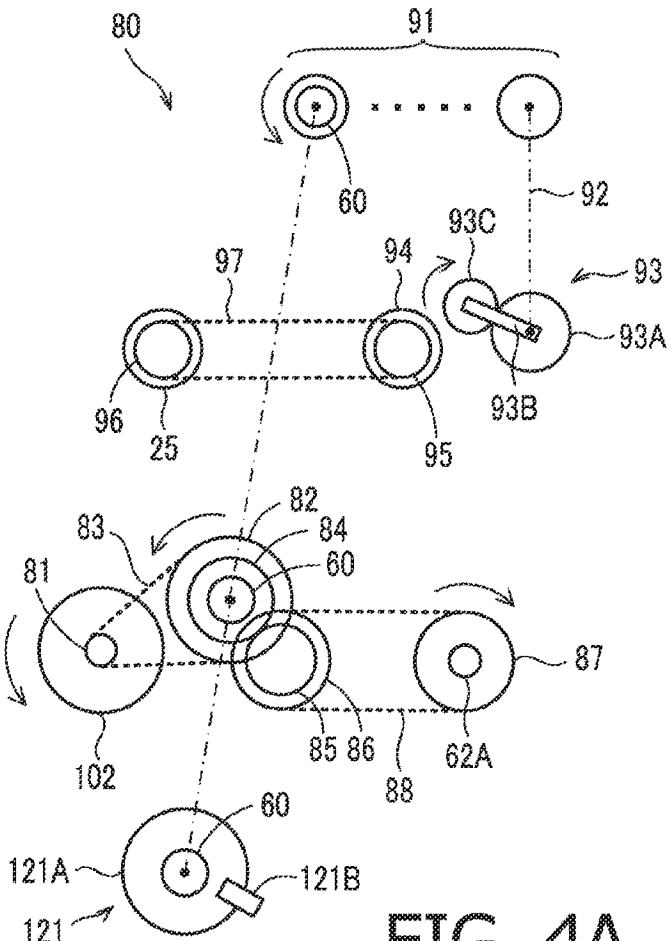

FIG. 4A schematically shows a configuration of a driving force transmission mechanism in a non-transmission state in the illustrative embodiment according to one or more aspects of the present disclosure.

FIG. 4B schematically shows a configuration of the driving force transmission mechanism in a transmission state in the illustrative embodiment according to one or more aspects of the present disclosure.

Figure 5:
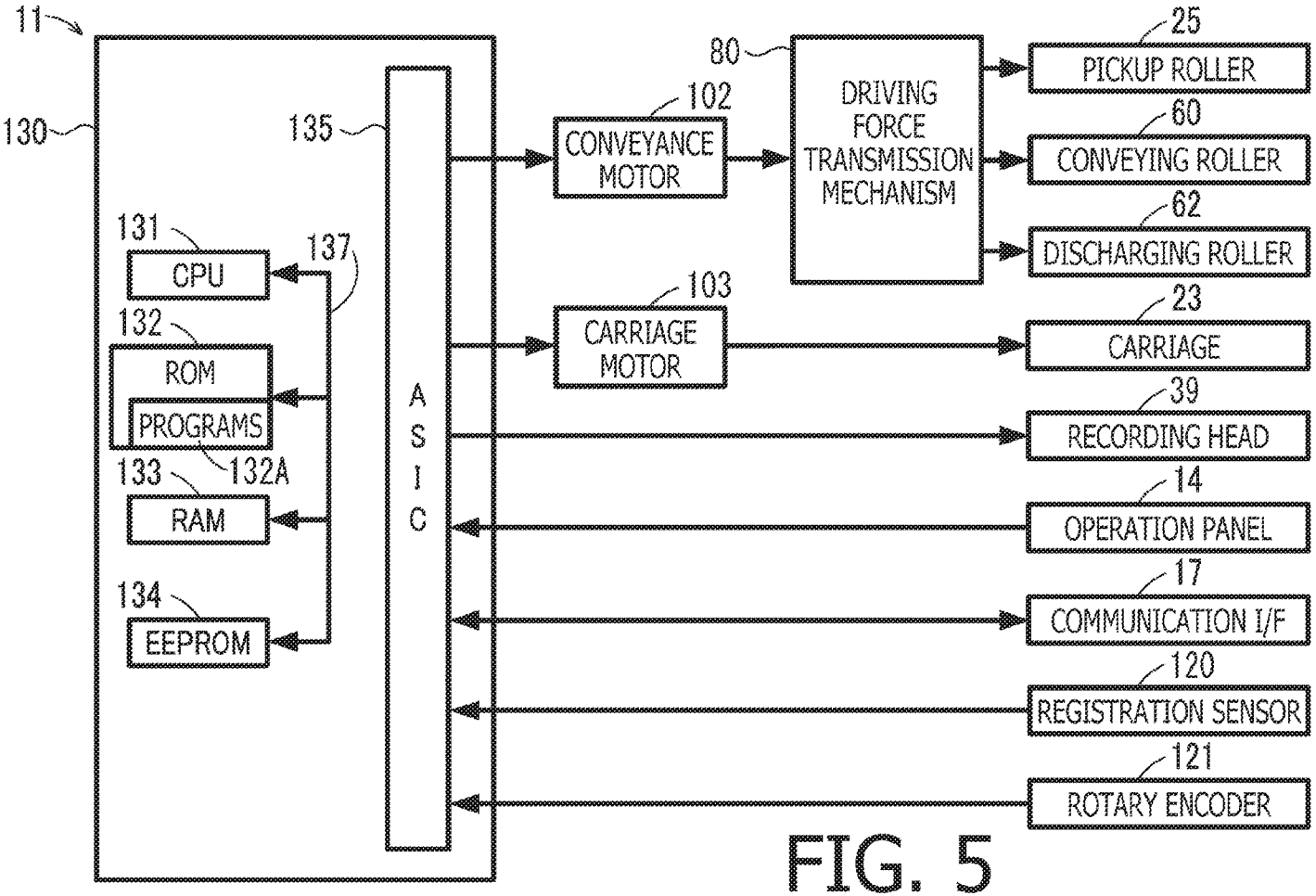

FIG. 5 is a block diagram showing an electrical configuration of the MFP in the illustrative embodiment according to one or more aspects of the present disclosure.

Figure 6:
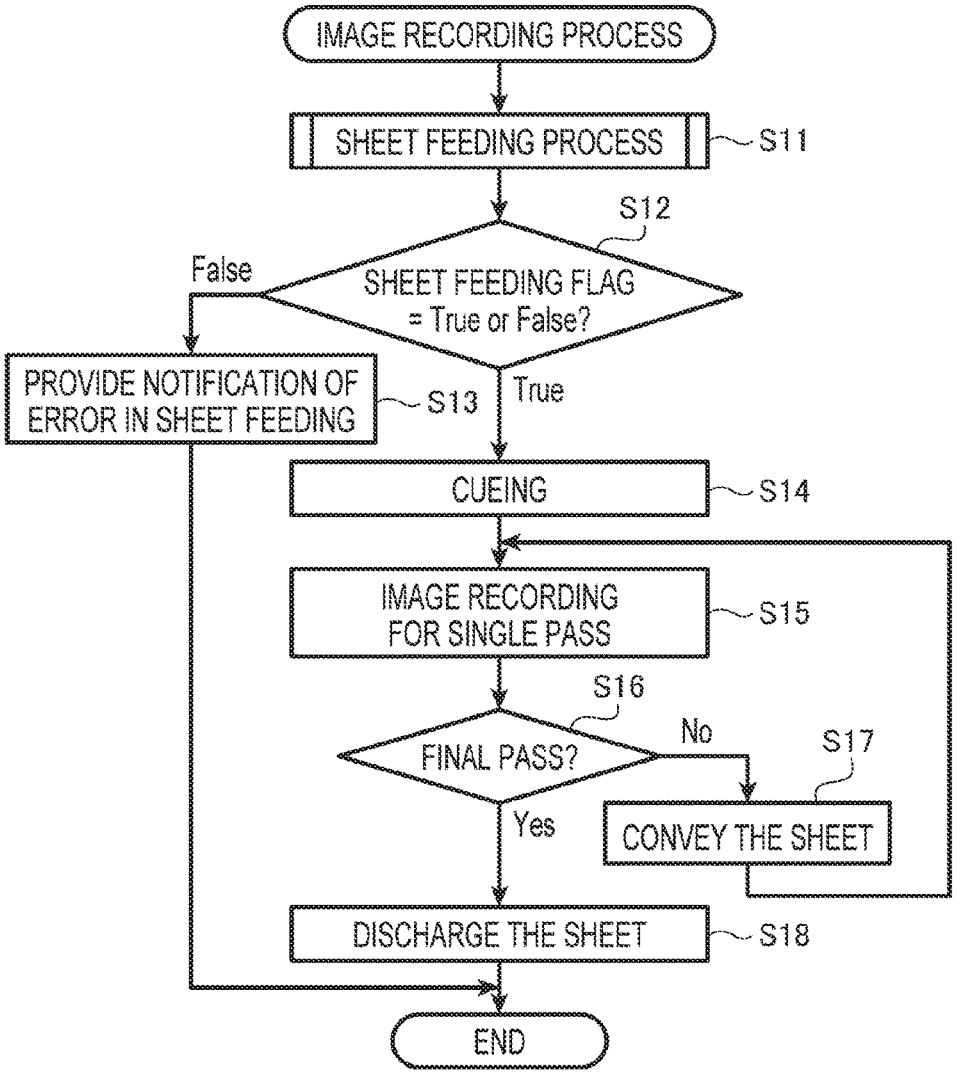

FIG. 6 is a flowchart showing a procedure of an image recording process in the illustrative embodiment according to one or more aspects of the present disclosure.

Figure 7:
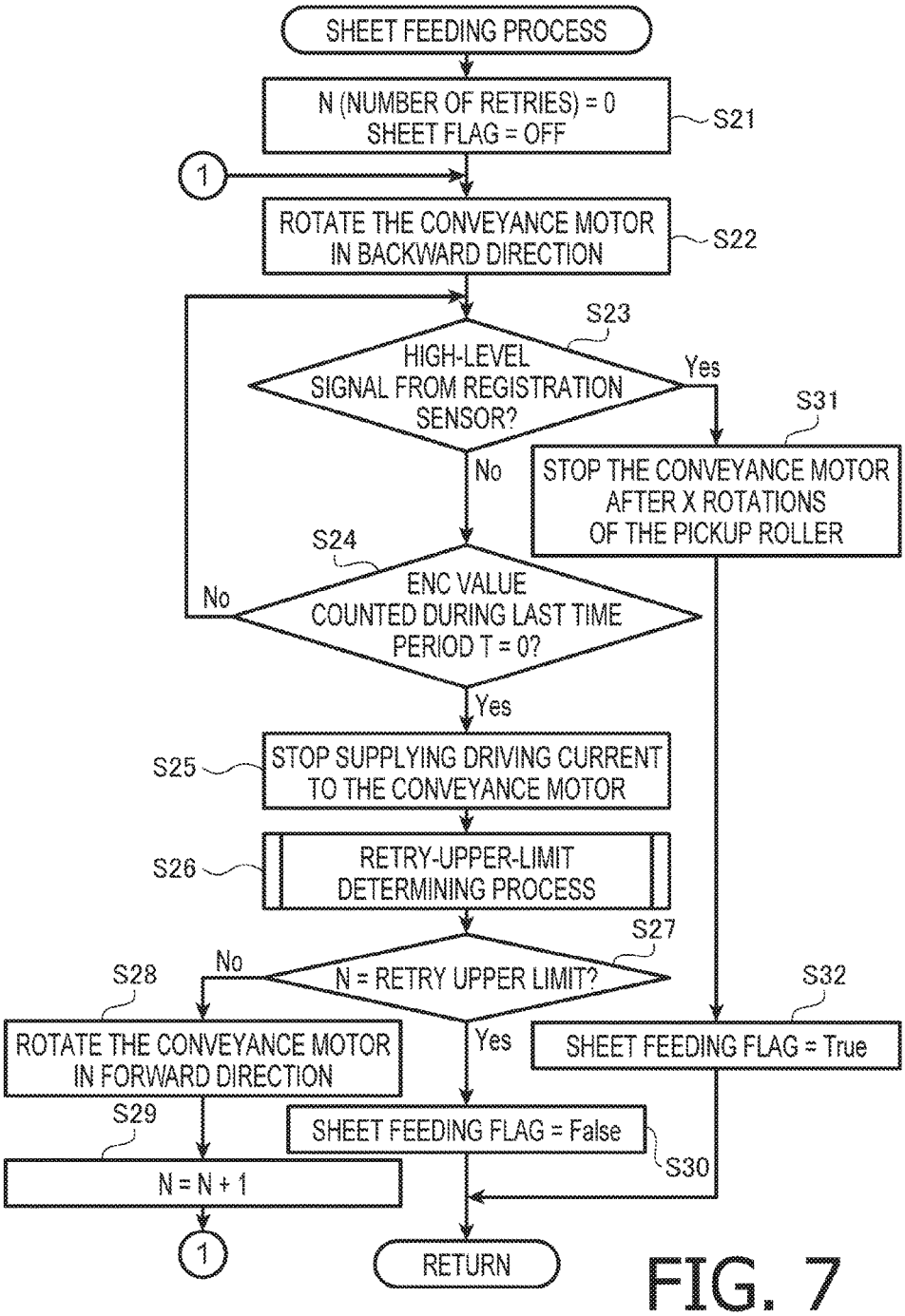

FIG. 7 is a flowchart showing a procedure of a sheet feeding process in the illustrative embodiment according to one or more aspects of the present disclosure.

Figure 8:
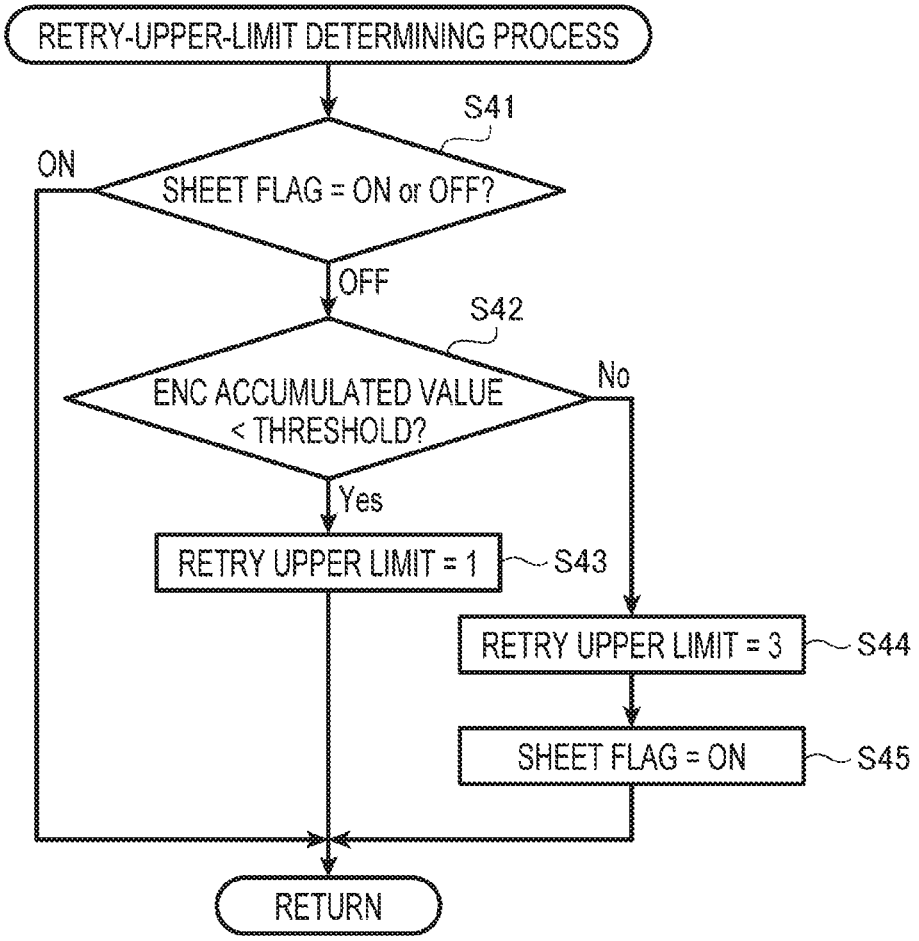

FIG. 8 is a flowchart showing a procedure of a retry-upper-limit determining process in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings. In the following description, a vertical direction 7 is defined on the basis of a state (e.g., a state shown in FIG. 1) where a multi-function peripheral (hereinafter referred to as an "MFP") 10 is installed in a usable condition. In addition, a front-to-rear direction 8 is defined with a side having an opening 13 as a front side of the MFP 10. Further, a left-to-right direction 9 is defined in a front view of the MFP 10 (i.e., when the MFP 10 is viewed from the front side). Furthermore, it is noted that the vertical direction 7 may represent an upward direction and a downward direction therealong. Likewise, the front-to-rear direction 8 may represent a frontward direction and a rearward direction therealong. The left-to-right direction 9 may represent a leftward direction and a rightward direction therealong.

[Overall Configuration of MFP]

Figure 1:
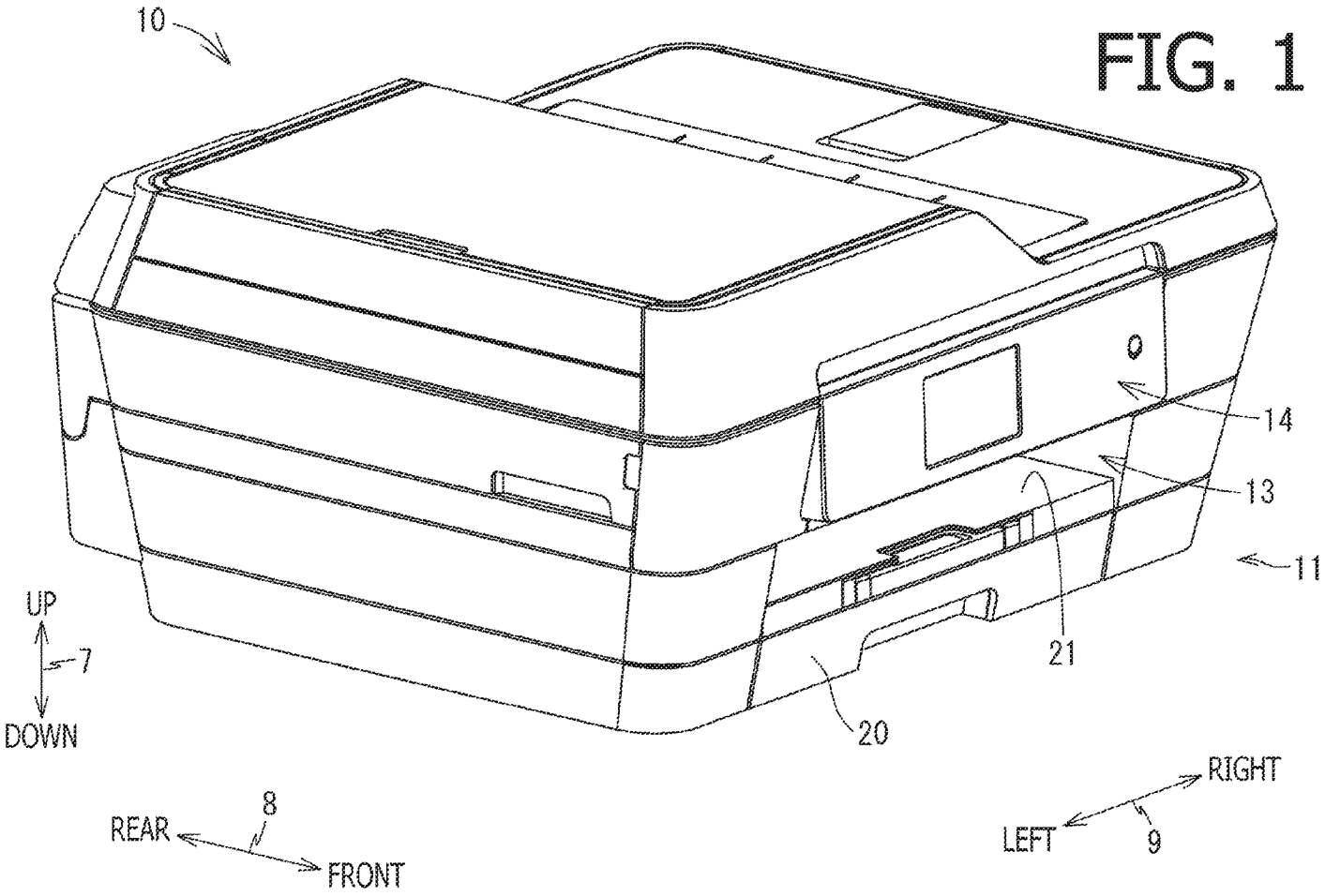
FIG. 1 is a perspective view showing an external appearance of a multi-function peripheral (hereinafter referred to as an "MFP") in an illustrative embodiment according to one or more aspects of the present disclosure.

As shown in FIG. 1, the MFP 10 is formed substantially in a rectangular parallelepiped. The MFP 10 includes a printer 11. Further, the MFP 10 may include an image scanner configured to scan an image of a document sheet and generate image data.

[Printer]

Figure 2:
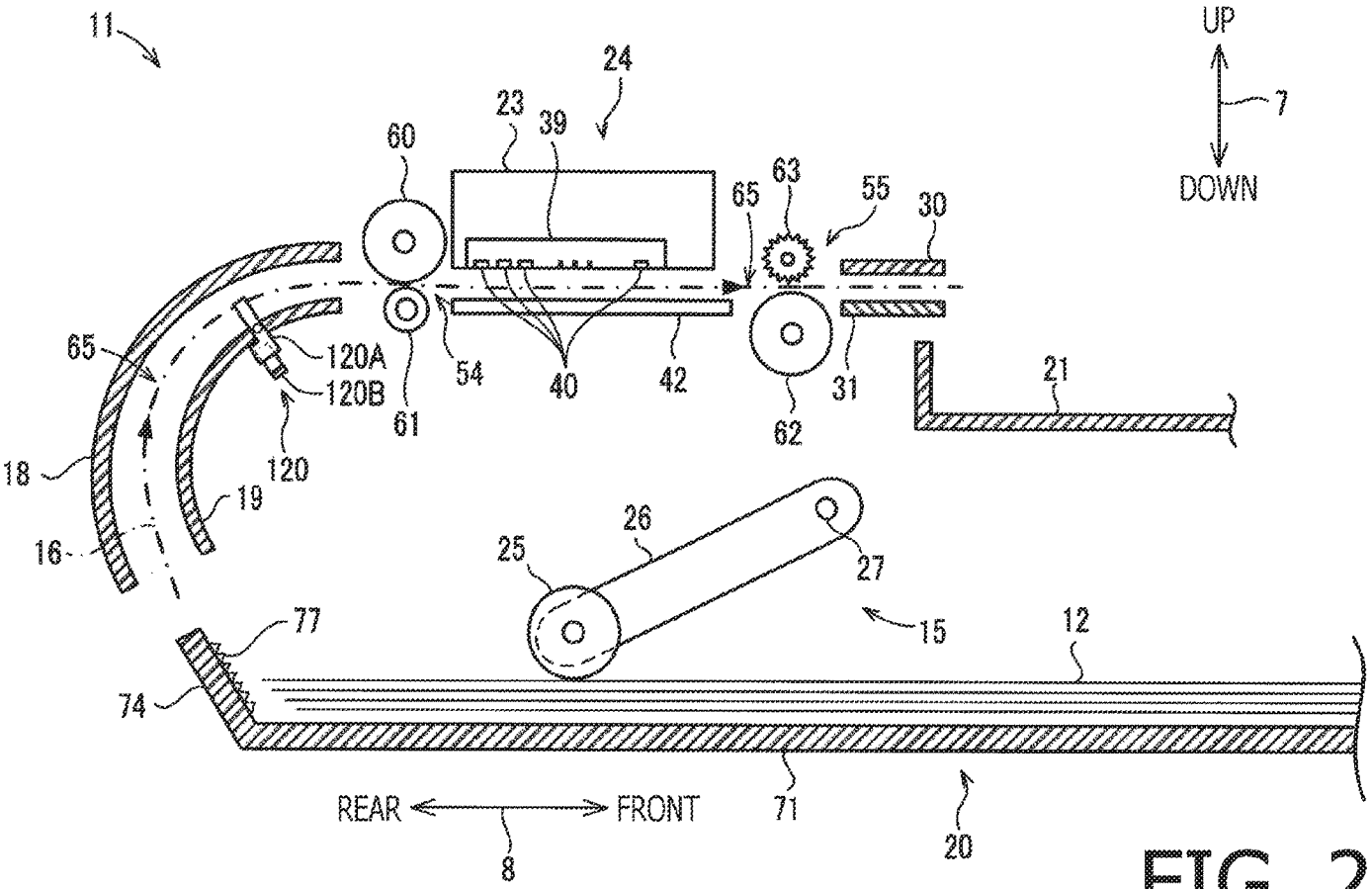
FIG. 2 is a cross-sectional side view schematically showing an internal configuration of a printer included in the MFP, in the illustrative embodiment according to one or more aspects of the present disclosure.

The printer 11 is an inkjet printer configured to record, on a sheet 12 (see FIG. 2), an image represented by image data by discharging ink droplets. Nonetheless, an image recording method of the printer 11 is not limited to the inkjet method, but may be an electrophotographic method. As shown in FIG. 2, the printer 11 includes a sheet feeder 15, a feed tray 20, a discharge tray 21, conveyance rollers 54, an image recorder 24, discharge rollers 55, and a platen 42.

[Feed Tray and Discharge Tray]

As shown in FIG. 1, an opening 13 is formed at a front surface of the printer 11. The feed tray 20 is inserted into and pulled out of the printer 11 via the opening 13 along the front-to-rear direction 8. As shown in FIG. 2, the feed tray 20 is configured to support a plurality of sheets 12 stacked thereon. The discharge tray 21 is disposed above the feed tray 20. The discharge tray 21 is configured to support sheets 12 discharged by the discharge rollers 55.

Figure 3:
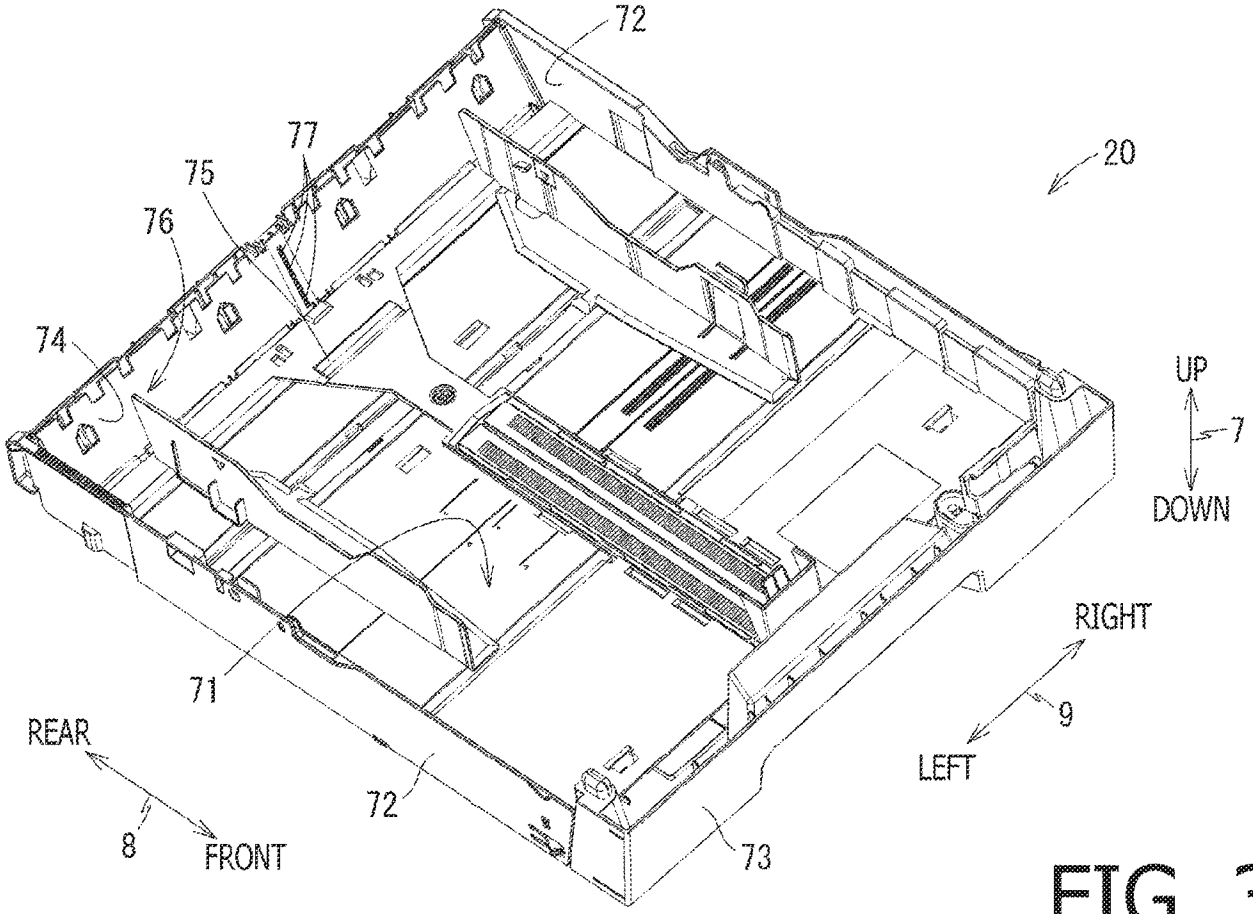
FIG. 3 is a perspective view showing a feed tray of the printer when viewed from an upper side thereof, in the illustrative embodiment according to one or more aspects of the present disclosure.

As shown in FIG. 3, the feed tray 20 is formed substantially in a box shape with an open upper side. The feed tray 20 has a bottom wall 71, two side walls 72, a front wall 73, and an inclined wall 74. Each side wall 72 erects from a corresponding one of both ends of the bottom wall 71 in the left-to-right direction 9 and extends along the front-to-rear direction 8. The front wall 73 erects from a front end of the bottom wall 71 and extends along the left-to-right direction 9. The inclined wall 74 erects from a rear end of the bottom wall 71 and extends along the left-to-right direction 9. Each of the bottom wall 71, the side walls 72, the front wall 73, and the inclined wall 74 may be made of a single material or made of two or more materials.

A friction pad 75 is disposed on the bottom wall 71. The friction pad 75 is fixedly attached onto the bottom wall 71 in a state where the friction pad 75 slightly protrudes upward from an upper surface of the bottom wall 71. The feed tray 20 supports the stacked sheets 12 on the upper surfaces of the bottom wall 71 and the friction pad 75. Further, the friction pad 75 is disposed in a position contactable with the pickup roller 25. Specifically, when one or more sheets 12 are placed on the feed tray 20, the pickup roller 25 is in contact with a top sheet 12 of the one or more sheets 12. Meanwhile, when there is no sheet 12 placed on the feed tray 20, the pickup roller 25 is in contact with the friction pad 75.

For instance, the friction pad 75 is made of material (e.g., cork) having a high frictional coefficient. Namely, the friction pad 75 is configured to make a rotational resistance of the pickup roller 25 rotating in contact with the friction pad 75 greater than a rotational resistance of the pickup roller 25 rotating in contact with a sheet 12 supported by the friction pad 75. Thereby, even when the number of sheets 12 stacked on the feed tray 20 is small, it is possible to prevent multi-feed in which two or more sheets 12 are fed in a mutually-overlapping state. Nonetheless, the friction pad 75 may be disposed in such a position as not to contact the pickup roller 25, or may be omitted. In this case, the bottom wall 71 may be made, e.g., of synthetic resin, and may be configured to make a rotational resistance of the pickup roller 25 rotating in contact with the bottom wall 71 greater than a rotational resistance of the pickup roller 25 rotating in contact with a sheet 12 supported by the bottom wall 71.

The inclined wall 74 has an inclined surface 76 formed to contact a leading end of a sheet 12 fed toward a conveyance path 65. The inclined surface 76 extends obliquely toward an upper rear side from a rear end portion of the bottom wall 71 in the front-to-rear direction 8. Namely, the inclined surface 76 is disposed between a rear end of a sheet supporting surface (i.e., an upper surface of the bottom wall 71) of the feed tray 20 and the conveyance path 65. The inclined surface 76 is configured to contact a leading end of a sheet 12 fed from the bottom wall 71 by the sheet feeder 15, and to guide the sheet 12 to the conveyance path 65. The inclined wall 74 may be an example of a guide according to aspects of the present disclosure. The guide may be supported by a frame (not shown) of the printer 11, between the feed tray 20 and the conveyance path 65.

Further, the inclined wall 74 includes a plurality of separation protrusions 77. Each separation protrusion 77 protrudes obliquely toward an upper front side from the inclined surface 76. The plurality of separation protrusions 77 are arranged in line along a direction extending obliquely toward an upper rear side. The plurality of separation protrusions 77 are configured to contact one or more lower sheets 12 of the plurality of sheets 12 stacked on the bottom wall 71 and separate the one or more sheets 12 from a top sheet 12. Thereby, it is possible to prevent multi-feed.

[Sheet Feeder]

As shown in FIG. 2, the sheet feeder 15 includes the pickup roller 25, a pickup arm 26, and a shaft 27. The pickup roller 25 is rotatably supported by an distal end portion of the pickup arm 26. The pickup arm 26 is rotatably supported by the shaft 27. The shaft 27 is supported by the frame (not shown) of the printer 11. The pickup arm 26 is urged toward the feed tray 20 by its own weight and/or an elastic force of a spring. The sheet feeder 15 is configured to feed the sheets 12 supported by the feed tray 20 to the conveyance path 65, by the pickup roller 25 rotating in a forward direction in response to receipt of a backward driving force transmitted by a conveyance motor 102 (see FIG. 5).

[Feeding Path]

The conveyance path 65 is a space defined by guide members 18, 19, 30, and 31, the image recorder 24, and the platen 42. The guide member 18 is opposed to the guide member 19 across a particular distance inside the printer 11. Likewise, the guide member 30 is opposed to the guide member 31 across a particular distance inside the printer 11. Further, likewise, the image recorder 24 and the platen 42 are opposed to each other across a particular distance inside the printer 11. The conveyance path 65 extends from a rear end portion of the feed tray 20 in a direction intersecting the upper surface of the bottom wall 71. Further, the conveyance path 65 U-turns while extending upward from a lower rear portion of the printer 11. Finally, the conveyance path 65 leads to the discharge tray 21 via a position to face the image recorder 24.

More specifically, the conveyance path 65 includes a curved path that is curved along a conveyance direction 16 in a region defined by the guide members 18 and 19. Further, the conveyance path 65 includes a straight path that linearly extends along the front-to-rear direction 8 in each of a region defined by the image recorder 24 and the platen 24 and a region defined by the guide members 30 and 31.

The conveyance direction 16 represents a traveling direction in which a sheet 12 is conveyed from the feed tray 20 to the discharge tray 21 via the conveyance path 65. Namely, the conveyance direction 16 is a direction that extends from a front end to a rear end of the feed tray 20 along the upper surface of the bottom wall 71, U-turns while extending upward and frontward along the curved path from the rear end of the feed tray 20, and extends forward along the straight path from a terminal end of the curved path. The conveyance direction 16 is indicated by an alternate long and short dash line arrow in FIG. 2.

[Feed Rollers]

The conveyance rollers 54 are disposed upstream of the image recorder 24 in the conveyance direction 16. The conveyance rollers 54 include a conveying roller 60 and a pinch roller 61 that are opposed to each other. The conveying roller 60 is configured to be driven by the conveyance motor 102 (see FIG. 5). The pinch roller 61 is configured to rotate in accordance with rotation of the conveying roller 60. Each sheet 12 is conveyed in the conveyance direction 16 while being pinched between the conveying roller 60, rotating in a forward direction in response to receipt of a forward driving force transmitted by the conveyance motor 102, and the pinch roller 61. The conveying roller 60 is further configured to rotate in a backward direction in response to receipt of a backward driving force transmitted by the conveyance motor 102. The backward direction is opposite to the forward direction.

[Discharge Rollers]

The discharge rollers 55 are disposed downstream of the image recorder 24 in the conveyance direction 16. The discharge rollers 55 include a discharging roller 62 and a spur 63 that are opposed to each other. The discharging roller 62 is configured to be driven by the conveyance motor 102. The spur 63 is configured to rotate in accordance with rotation of the discharging roller 62. Each sheet 12 is conveyed in the conveyance direction 16 while being pinched between the discharging roller 62, rotating in the forward direction in response to receipt of the forward driving force transmitted by the conveyance motor 102, and the spur 63.

[Registration Sensor]

As shown in FIG. 2, the printer 11 includes a registration sensor 120. The registration sensor 120 is disposed upstream of the conveyance rollers 54 in the conveyance direction 16. The registration sensor 120 includes a sensor arm 120A and an optical sensor 120B. The sensor arm 120A is configured to move (rotate) between a first state (see FIG. 2) and a second state. In the first state, the sensor arm 120A protrudes up to a position where the sensor arm 120A is allowed to contact a sheet 12 being conveyed through the conveyance path 65. In the second state, the sensor arm 120A retreats into the guide member 19 in response to a contact with a sheet 12 being conveyed through the conveyance path 65. Further, the sensor arm 120A is urged by a spring to be brought into the first state. The optical sensor 120B includes a light emitter (not shown) and a light receiver (not shown). The light emitter is configured to emit light. The light receiver is configured to receive the light emitted by the light emitter.

Hereinafter, a position of the sensor arm 120A in the first state within the conveyance path 65 may be referred to as an "arm position." The registration sensor 120 is configured to output different detection signals depending on whether there exists a sheet 12 in the arm position. Thus, the registration sensor 120 is configured to detect that a sheet 12 fed by the sheet feeder 15 has reached the arm position.

More specifically, the sensor arm 120A in the first state is positioned on an optical path between the light emitter and the light receiver. Therefore, the light receiver is not allowed to receive the light emitted by the light emitter. When the sensor arm 120A is in the first state (i.e., when there is no sheet 12 in the arm position), the registration sensor 120 transmits a low-level signal as a detection signal to a controller 130 (see FIG. 5). Meanwhile, the sensor arm 120A in the second state is positioned out of the optical path between the light emitter and the light receiver. Therefore, the light receiver is allowed to receive the light emitted by the light emitter. When the sensor arm 120A is in the second state (i.e., when there is a sheet 12 in the arm position), the registration sensor 120 transmits a high-level signal as a detection signal to the controller 130.

[Rotary Encoder]

As shown in FIG. 5, the printer 11 includes a rotary encoder 121 configured to generate pulse signals according to rotation of the pickup roller 25 and the conveying roller 60 (i.e., according to rotation of the conveyance motor 102). Thus, the rotary encoder 121 is configured to detect rotational quantities of the pickup roller 25 and the conveying roller 60 (i.e., detect a rotational quantity of the conveyance motor 10). More specifically, as shown in FIGS. 4A and 4B, the rotary encoder 121 includes an encoder disk 121A and an optical sensor 121B. The optical sensor 121B generates pulse signals by reading the rotating encoder disk 121A, and transmits the generated pulse signals to the controller 130.

[Image Recorder and Platen]

As shown in FIG. 2, the image recorder 24 and the platen 42 are disposed between the conveyance rollers 54 and the discharge rollers 55 in the conveyance direction 16. More specifically, the image recorder 24 and the platen 42 are disposed downstream of the conveyance rollers 54 and upstream of the discharge rollers 55 in the conveyance direction 16. Further, the image recorder 24 and the platen 42 are opposed to each other in the vertical direction 7.

The image recorder 24 includes a carriage 23 and a recording head 39 mounted on the carriage 23. The carriage 23 is configured to reciprocate along the left-to-right direction 9 in response to receipt of a driving force transmitted by a carriage motor 103 (see FIG. 5). The recording head 39 includes a plurality of nozzles 40 formed in a lower surface of the recording head 39. The recording head 39 is configured to discharge ink droplets from the nozzles 40 by vibrating vibrators such as piezoelectric elements. By controlling the recording head 39 to selectively discharge ink droplets from the nozzles 40 onto a sheet 12 supported by the platen 42 while controlling the carriage 23 to move along the left-to-right direction 9, the printer 11 (more specifically, the controller 130) records an image on the sheet 12. Hereinafter, an area on a sheet 12 in which an image is recorded during the movement of the carriage 23 from an end position to the other end position in the left-to-right direction 9 may be referred to as a "pass."

[Driving Force Transmission Mechanism]

As shown in FIGS. 4A, 4B, and 5, the printer 11 includes a driving force transmission mechanism 80. The driving force transmission mechanism 80 is configured to transmit a rotational driving force from the conveyance motor 102 to the pickup roller 25, the conveying roller 60, and the discharging roller 62. Nonetheless, a specific configuration of the driving force transmission mechanism 80 is not limited to a configuration exemplified in FIGS. 4A and 4B.

As shown in FIGS. 4A and 4B, the driving force transmission mechanism 80 includes pulleys 81 and 82 and an endless belt 83. The pulley 81 is configured to rotate integrally with a motor shaft of the conveyance motor 102. The pulley 82 is configured to rotate integrally with the conveying roller 60. The endless belt 83 is wound around the pulleys 81 and 82. Further, the driving force transmission mechanism 80 includes gears 84 and 85, pulleys 86 and 87, and an endless belt 88. The gear 84 is configured to rotate integrally with the conveying roller 60. The gear 85 is in engagement with the gear 84. The pulley 86 is configured to rotate integrally with the gear 85. The pulley 87 is configured to rotate integrally with a shaft 62A of the discharging roller 62. The endless belt 88 is wound around the pulleys 86 and 87. Thereby, the driving force transmission mechanism 80 is allowed to rotate each of the conveying roller 60 and the discharging roller 62 in the forward direction by the forward driving force from the conveyance motor 102. Further, the driving force transmission mechanism 80 is allowed to rotate each of the conveying roller 60 and the discharging roller 62 in the backward direction by the backward driving force from the conveyance motor 102.

Further, the driving force transmission mechanism 80 includes a gear train 91, a pendulum gear mechanism 93, a gear 94, pulleys 95 and 96, and an endless belt 97. The gear train 91 is configured to transmit the rotation of the conveyance motor 60 to a rotational shaft 92. The pendulum gear mechanism 93 is configured to rotate in accordance with rotation of the rotational shaft 92. The gear 94 is configured to come into contact with and separate from a pendulum gear 93C. The pulley 95 is configured to rotate integrally with the gear 94. The pulley 96 is configured to rotate integrally with the pickup roller 25. The endless belt 97 is wound around the pulleys 95 and 96. The pendulum gear mechanism 93 includes a sun gear 93A, a supporting arm 93B, and the pendulum gear 93C. The sun gear 93A is configured to rotate integrally with the rotational shaft 92. The supporting arm 93B is rotatably attached to the rotational shaft 92. The pendulum gear 93C is rotatably supported by a distal end portion of the supporting arm 93B, and is in engagement with the sun gear 93A. The pendulum gear 93C is configured to, when a rotational driving force is transmitted from the conveyance motor 102 to the sun gear 93A, rotate on its axis while revolving around the sun gear 93A.

More specifically, as shown in FIG. 4A, when the forward driving force is transmitted from the conveyance motor 102 to the sun gear 93A, the pendulum gear 93C revolves around the sun gear 93A in such a direction as to separate away from the gear 94. Thereby, the forward driving force from the conveyance motor 102 is not transmitted to the pickup roller 25. A state of the pendulum gear mechanism 93 shown in FIG. 4A may be referred to as a "non-transmission state." Meanwhile, when the backward driving force is transmitted from the conveyance motor 102 to the sun gear 93A, the pendulum gear 93C revolves around the sun gear 93A in such a direction as to approach the gear 94 and comes into engagement with the gear 94. Thereby, the driving force transmission mechanism 80 rotates the pickup roller 25 in the forward direction by the backward driving force from the conveyance motor 102. A state of the pendulum gear mechanism 93 shown in FIG. 4B may be referred to as a "transmission state."

[Controller]

As shown in FIG. 5, the controller 130 includes a CPU 131, a ROM 132, a RAM 133, an EEPROM 134, and an ASIC 135 that are interconnected via an internal bus 137. The ROM 132 stores therein programs 132A for the CPU 131 to control various operations. The RAM 133 is used as a storage area for temporarily storing data and/or signals that are used when the CPU 131 executes the programs 132A, and is used as a work area for data processing. The EEPROM 134 stores setting information that is to be held even after the printer 11 (the MFP 10) is turned off.

The ASIC 135 is connected with the conveyance motor 102 and the carriage motor 103. The ASIC 135 is configured to supply a driving current to each of the motors 102 and 103 via driving circuits (not shown). Each of the conveyance motor 102 and the carriage motor 103 is a DC motor configured to rotate at a higher rotational speed as supplied with a larger driving current and to rotate at a lower rotational speed as supplied with a smaller driving current. The controller 130 may control each of the conveyance motor 102 and the carriage motor 103 by so-called PWM control ("PWM" is an abbreviated form of Pulse Width Modulation).

More specifically, in each of below-mentioned processes, the controller 130 controls each of the motors 102 and 103 in such a manner as to bring the rotational speed of each of the motors 102 and 103 close to a previously-set target rotational speed. Namely, when the rotational speed of each of the motors 102 and 103 is lower than the target rotational speed, the controller 130 increases the driving current to be supplied thereto. Meanwhile, when the rotational speed of each of the motors 102 and 103 is higher than the target rotational speed, the controller 130 decreases the driving current to be supplied thereto. Nonetheless, the controller 130 does not supply any of the motors 102 and 103 with a driving current larger than a previously-set maximum current.

Further, the controller 130 applies a driving voltage to the vibrators of the recording head 39, thereby causing the nozzles 40 to discharge ink droplets therefrom. Further, the ASIC 135 is connected with the registration sensor 120 and the rotary encoder 121. The controller 130 detects states of the printer 11 based on signals output from the registration sensor 120 and the rotary encoder 121.

More specifically, the controller 130 detects that a sheet 12 has reached the arm position, based on a detection signal output from the registration sensor 120. Further, the controller 130 detects a rotational quantity of each of the rollers 25, 60, and 62 based on pulse signals output from the rotary encoder 121. In other words, the controller 130 detects a rotational quantity of the conveyance motor 102 based on pulse signals output from the rotary encoder 121. Further, the controller 130 detects a position of the sheet 12 within the conveyance path 65, based on a pulse signal output from the rotary encoder 121 after a high-level signal is output from the registration sensor 120.

Further, the ASIC 135 is connected with an operation panel 14. For instance, the operation panel 14 may include at least one of a display, LED lamps, push buttons, and touch sensors that are provided on an outer surface of the MFP 10. The controller 130 provides various kinds of information via the display and/or the LED lamps, and accepts user instructions via the push buttons and/or the touch sensors.

Further, the ASIC 135 is connected with a communication interface (hereinafter referred to as a "communication I/F") 17. The communication I/F 17 is configured to communicate with information processing devices (not shown). Namely, the controller 130 transmits various kinds of information to an information processing device via the communication I/F 17, and receives various kinds of information from an information processing device via the communication I/F 17. The communication I/F 17 may be configured to perform wireless communication according to a Wi-Fi communication protocol ("Wi-Fi" is a trademark registered by Wi-Fi Alliance), and/or to perform wired communication via a LAN cable or a USB cable.

[Image Recording Process]

Subsequently, referring to FIGS. 6 to 8, an image recording process of the illustrative embodiment will be described. Each of the following processes may be performed by the CPU 131 reading and executing one or more programs 132A stored in the ROM 132, or may be implemented by one or more hardware circuits incorporated in the controller 130.

As an example, in response to receipt of a print instruction from an information processing device via the communication I/F 17, the controller 130 starts the image recording process to record, on a sheet 12, an image represented by image data included in the received print instruction. As another example, in response to receipt of a copy instruction from a user via the operation panel 14, the controller 130 starts the image recording process to record, on a sheet 12, an image represented by image data generated by the image scanner.

First, the controller 130 performs a sheet feeding process (S11). The sheet feeding process is a process to feed a sheet 12 supported by the feed tray 20, to the conveyance rollers 54 through the conveyance path 65. The sheet feeding process will be described in detail with reference to FIG. 7.

The controller 130 initializes the number N of retries and a sheet flag that are stored in the RAM 133 (S21). The number N of retries is a variable representing the number of retries to execute a below-mentioned step S22. An initial value of the number N of retries is zero. The sheet flag is information representing a presumption as to whether there is a sheet 12 placed on the feed tray 20. The sheet flag is set to "ON" or "OFF." Specifically, the sheet flag set to "ON" represents that there is a sheet 12 placed on the feed tray 20. Meanwhile, the sheet flag set to "OFF" represents that there is no sheet 12 placed on the feed tray 20. An initial value of the sheet flag is "OFF."

Subsequently, the controller 130 supplies the conveyance motor 102 with a driving current for rotating the pickup roller 25 in the forward direction, i.e., a driving current for rotating the conveyance motor 102 in the backward direction (S22). Then, the controller 130 continues to supply the driving current in such a manner as to bring the rotational speed of the conveyance motor 102 close to the target rotational speed, until a high-level signal is output from the registration sensor 120 (S23: Yes) or the number (hereinafter referred to as an "enc value") of pulses output from the rotary encoder 121 during the last time period T becomes zero (S24: Yes).

In response to the enc value counted during the last time period T being zero before a high-level signal is output from the registration sensor 120 (S23: No, and S24: Yes), the controller 130 stops supplying the driving current to the conveyance motor 102 (S25). Nonetheless, the controller 130 may continue to supply a holding current for causing the conveyance motor 102 to hold its present position. The enc value counted during the last time period T being equal to zero represents that the conveyance motor 102 has not rotated all the time during the last time period T, i.e., that the pickup roller 25 has not rotated all the time during the last time period T. Then, the controller 130 performs a retry-upper-limit determining process (S26). The retry-upper-limit determining process is a process to determine an upper limit of the number N of retries to execute S22. The retry-upper-limit determining process will be described with reference to FIG. 8.

First, the controller 130 determines whether the sheet flag is set to "ON" or "OFF" (S41). It is noted that, in the retry-upper-limit determining process (hereinafter referred to as the "first retry-upper-limit determining process") to be performed for the first time after the sheet feeding process is started, the setting value of the sheet flag is "OFF." Namely, the steps S42 to S45 are executed without fail in the first retry-upper-limit determining process. Next, in response to determining that the sheet flag is set to "OFF" (S41: OFF), the controller 130 determines whether the number (hereinafter referred to as an "enc accumulated value") of pulses output from the rotary encoder 121 during a period of time for the last-executed steps S22 to S25 is less than a predetermined threshold (S42). For instance, the predetermined threshold may be 35000 (enc).

In response to determining that the enc accumulated value is less than the predetermined threshold (S42: Yes), the controller 130 sets the retry upper limit (i.e., the upper limit of the number N of retries) to one (S43). When the enc accumulated value is less than the predetermined threshold, it represents that the pickup roller 25 has not rotated since the beginning of S22. As an example, when S22 is executed in a state where the pickup roller 25 is in contact with the friction pad 75 with no sheet 12 placed on the feed tray 20 (i.e., no sheet to be fed), the enc accumulated value may be less than the predetermined threshold. As another example, when the sheet 12 fed by the pickup roller 25 in S22 comes into contact with the separation protrusions 77 and thereby becomes unable to travel any further (i.e., sheet jam), the enc accumulated value may be less than the predetermined threshold.

Meanwhile, in response to determining that the enc accumulated value is equal to or more than the predetermined threshold (S42: No), the controller 130 sets the retry upper limit to three (S44). When the enc accumulated value is equal to or more than the predetermined threshold, it represents that the pickup roller 25 comes into an unrotatable state after rotating for a while in S22. For instance, when the sheet 12 fed into the conveyance path 65 by the pickup roller 25 sticks onto a curved inner surface of the guide member 18 and thereby becomes unable to travel any further (i.e., sheet jam), the enc accumulated value may be less than the predetermined threshold. Further, in this case, it is presumed that there exists a sheet 12 on the feed tray 20 or in the conveyance path 65. Therefore, the controller 130 sets the sheet flag to "ON" (S45).

In the illustrative embodiment, when the enc accumulated value is less than the predetermined threshold (S42: Yes), the retry upper limit is set to one (hereinafter, which may be referred to as a "first value"). Further, when the enc accumulated value is equal to or more than the predetermined threshold (S42: No), the retry upper limit is set to three (hereinafter, which may be referred to as a "second value"). The first value is not limited to one, and the second value is not limited to three. Nonetheless, it is noted that the first value is equal to or more than one, and that the second value is more than the first value. An explanation will be provided later of operations to be performed when the controller 130 determines that the sheet flag is set to "ON" (S41: ON).

Subsequently, referring back to FIG. 7, the controller 130 compares the number N of retries with the retry upper limit (S27). In response to determining that the number N of retries is less than the retry upper limit (S27: No), the controller 130 supplies the conveyance motor 102 with a driving current having such a direction as to separate the pendulum gear 93C away from the gear 94, i.e., a driving current having such a direction as to rotate the conveyance motor 102 in the forward direction (S28). Namely, in S28, the conveyance motor 102 is supplied with a driving current that is directed opposite to the driving current supplied thereto in S22. Thereby, the pendulum gear mechanism 93 is switched into the non-transmission state from the transmission state.

Next, the controller 130 increments the number N of retries by one (S29). Subsequently, the controller 130 repeatedly performs (i.e., retries to execute) the steps S22 to S29 until a high-level signal is output from the registration sensor 120 (S23: Yes) or the number N of retries reaches the retry upper limit (S27: Yes). It is noted that, for instance, in S22 executed for the second or subsequent time after the beginning of the sheet feeding process, the pendulum gear 93C may be brought into engagement with the gear 94 (i.e., the pendulum gear mechanism 93 may be switched into the transmission state from the non-transmission state) in response to the conveyance motor 102 being driven to rotate in the backward direction. Then, the controller 130 may begin to count the enc value and the enc accumulated value from a point of time when the pendulum gear mechanism 93 is put in the transmission state.

Further, in S26 executed for the second or subsequent time after the beginning of the sheet feeding process, the controller 130 again executes the steps S42 to S45 in response to determining that the sheet flag is set to "OFF" (S41: OFF). Namely, when it is not presumed in a previously-performed retry-upper-limit determining process that there exists a sheet 12 on the feed tray 20 or in the conveyance path 65, the retry upper limit may be updated. For instance, as a case where the retry upper limit is changed from the first value to the second value, the following case may be considered. That is a case where a sheet 12, which has been unable to travel any further due to contact with the separation protrusions 77, has somehow entered the conveyance path 65 in the last-executed S22 but eventually become unable to travel any further due to sticking onto the curved inner surface of the guide member 18.

Meanwhile, in S26 executed for the second or subsequent time after the beginning of the sheet feeding process, in response to determining that the sheet flag is set to "ON" (S41: ON), the controller 130 terminates the retry-upper-limit determining process without executing any of the steps S42 to S45. Namely, when it is presumed in the previously-performed retry-upper-limit determining process that there exists a sheet 12 on the feed tray 20 or in the conveyance path 65, the retry upper limit is not updated.

Then, in response to determining that the number N of retries has reached the retry upper limit (S27: Yes), the controller 130 sets a sheet feeding flag stored in the RAM 133 to "False" (S30). Thereafter, the controller 130 terminates the sheet feeding process. When the sheet feeding flag is "False," it represents that the sheet 12 has not reached the arm position even after repeated execution of the steps S22 to S29.

Meanwhile, in response to determining that a high-level signal has been output from the registration sensor 120 during execution of S22 (S23: Yes), the controller 130 drives the conveyance motor 102 to rotate in the backward direction, thereby further rotating the pickup roller 25 by X rotations, and thereafter stops supplying the driving current to the conveyance motor 102 (S31). The X rotations are equivalent to the number of rotations of the pickup roller 25 that is required to bring the leading end of the sheet 12 that has reached the arm position into contact with the conveyance rollers 54 rotating in the backward direction. Then, the controller 130 sets the sheet feeding flag to "True" (S32). Thereafter, the controller 130 terminates the sheet feeding process. When the sheet feeding flag is "True," it represents that, in S22 executed at least once, the sheet 12 has reached the arm position, and the leading end of the sheet 12 has come into contact with the conveyance rollers 54.

Next, referring back to FIG. 6, the controller 130 determines whether the sheet feeding flag is set to "True" or "False" (S12). Then, in response to determining that the sheet feeding flag is set to "False" (S12: False), the controller 130 provides a notification that the sheet 12 has not reached the arm position, via the operation panel 14 (S13). More specifically, the controller 130 may show a message or an animation on the display of the operation panel 14, or may turn on a corresponding LED lamp of the operation panel 14.

Meanwhile, in response to determining that the sheet feeding flag is set to "True" (S12: True), the controller 130 drives the conveyance motor 102 to rotate in the forward direction, thereby causing the conveyance rollers 54 to convey the sheet 12 to such a position that a first pass of the sheet 12 in contact with the conveyance rollers 54 faces the recording head 39 (S14). Subsequently, the controller 130 drives the carriage motor 103 to move the carriage 23 and controls the recording head 39 to discharge ink droplets from the nozzles 40 at timing specified by the image data. Thereby, the controller 130 controls the recording head 39 to record an image in the pass that faces the recording head 39 (S15).

Next, the controller 130 determines whether the pass with an image recorded therein in the last-executed S15 is a final pass (S16). In response to determining that the pass with an image recorded therein in the last-executed S15 is not a final pass (S16: No), the controller 103 drives the conveyance motor 102 to rotate in the forward direction, thereby causing the conveyance rollers 54 and the discharge rollers 55 to convey the sheet 12 to such a position that a next pass of the sheet 12 faces the recording head 39 (S17).

The controller 130 repeatedly performs the steps S15 to S17 until an image is recorded in the final pass (S16: Yes). In response to an image being recorded in the final pass (S16: Yes), the controller 130 drives the conveyance motor 102 to rotate in the forward direction, thereby causing the discharge rollers 55 to convey the sheet 12 until the sheet 12 with an image recorded thereon is discharged onto the discharge tray 21 (S18).

[Operations and Advantageous Effects of Illustrative Embodiment]

According to the aforementioned illustrative embodiment, it is possible to prevent the printer 11 from being damaged, by setting a smaller number of retries when it is highly presumable that there is no sheet 12 to be fed. Further, even when it is highly presumable that there is no sheet 12 to be fed, the step S22 is once retried. Therefore, even though "sheet jam" is mistakenly detected as "no sheet to be fed," it is possible to provide an opportunity to solve "sheet jam." Further, by setting a larger number of retries when it is highly presumable that "sheet jam" is occurring, it is possible to enhance the possibility that the sheet 12 is successfully conveyed to the position of the registration sensor 120.

Further, for instance, as a case where it is determined that the enc accumulated value in S22 executed for the first time after the beginning of the sheet feeding process, is less than the predetermined threshold, the following cases may be considered. Those are a case of "no sheet to be fed" and a case where a sheet 12 placed on the feed tray 20 has hardly moved. Meanwhile, when the enc accumulated value becomes equal to or more than the predetermined threshold, the possibility of "no sheet to be fed" is considered to be extremely low. Thus, as exemplified in the aforementioned illustrative embodiment, at a stage where both the possibility of "no sheet to be fed" and the possibility of "sheet jam" exist (i.e., at a stage where the sheet flag is "OFF"), it is desired to execute the steps S42 to S45 each time it is determined that the conveyance motor 102 has not rotated during the last time period T.

Further, when the conveyance motor 102 is inhibited from rotating, due to occurrence of "sheet jam," a force to urge the pickup roller 25 to rotate in the backward direction opposite to the forward direction is applied to the pickup roller 25 by the sheet 12. Nonetheless, in the aforementioned illustrative embodiment, between S25 and S22, the pendulum gear mechanism 93 is switched into the non-transmission state. Thereby, the sheet 12 travels in a direction opposite to the conveyance direction 16. Hence, it is possible to enhance the possibility that the sheet 12 is appropriately conveyed in next-executed S22. In the aforementioned illustrative embodiment, the pendulum gear mechanism 93 is exemplified as a switcher. Nonetheless, a specific example of the switcher is not limited to the pendulum gear mechanism 93. For instance, a transmission destination of the driving force from the conveyance motor 102 may be switched by the carriage 23. Further, in S28, instead of bringing the switcher into the non-transmission state, the controller 130 may stop supplying the holding current to the conveyance motor 102.

Further, in the aforementioned illustrative embodiment, in response to the number N of retries reaching the retry upper limit, the controller 130 executes S13. Thereby, it is possible to let the user know that the sheet 12 has not reached the arm position. In S13, the controller 130 may provide more detailed information in accordance with the setting value of the sheet flag. Specifically, for instance, the controller 130 may provide a notification indicating "no sheet to be fed" when the sheet flag is set to "OFF." Meanwhile, the controller 130 may provide a notification indicating "sheet jam" when the sheet flag is set to "ON."

Further, it is considered that an event that the conveyance motor 102 is inhibited from rotating, due to occurrence of "no sheet to be fed" or "sheet jam" is more likely to be caused when the printer 11 has at least one of the following structural features. Those are a feature that the friction pad 75 is provided on the bottom wall 71, a feature that the inclined wall 74 is provided between the feed tray 20 and the conveyance path 65, and a feature that the conveyance path 65 includes the curved path. The processes shown in FIGS. 7 and 8 provide advantageous effects as above, in particular when applied to the printer 11 having all of the above structural features as exemplified in the illustrative embodiment.

Further, than a plain paper, a glossy paper has a stronger restoring force for returning to an original state of the paper when the paper is deformed along the curved path. Therefore, the glossy paper is more likely to become unable to travel any further after sticking to the guide member 18 in the sheet feeding process. Hence, the controller 130 may execute S26 when the print instruction or the copy instruction includes an instruction to feed a glossy paper. Meanwhile, the controller 130 may not execute S26 when the print instruction or the copy instruction includes an instruction to feed a plain paper.

A method for determining in S24 that the conveyance motor 102 has not rotated all the time during the last time period T is not limited to the method exemplified in the aforementioned illustrative embodiment. As a modification, in response to having continued to supply a maximum current to the conveyance motor 102 during the last time period T, the controller 130 may determine that the conveyance motor 102 has not rotated. In this case, when the pickup roller 25 slips in contact with the friction pad 75 or a jammed sheet 12, the conveyance motor 102 might slightly rotate. Namely, even when the controller 130 determines that the conveyance motor 102 has not rotated (S24: Yes) in the method exemplified in the modification, the conveyance motor 102 may have actually made a slight rotation.

Further, as exemplified in the aforementioned illustrative embodiment, the pickup roller 25, the conveying roller 60, and the discharging roller 62 are rotated by the driving force from the conveyance motor 102. Nonetheless, a feed motor for rotating the pickup roller 25 may be provided apart from the conveyance motor 102. In this case, the printer 11 needs to have a sensor for detecting the rotational quantities of the feed motor and the pickup roller 25, apart from the rotary encoder 121.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein.

With respect to associations of elements exemplified in the aforementioned illustrative embodiment with elements to be defined according to aspects of the present disclosure, the feed tray 20 may be an example of a "tray" according to aspects of the present disclosure. The bottom wall 71 or the friction pad 75 may be an example of a "supporter" according to aspects of the present disclosure. The pickup roller 25 may be an example of a "roller" according to aspects of the present disclosure. The conveyance motor 102 may be an example of a "motor" according to aspects of the present disclosure. The rotary encoder 121 may be an example of a "first sensor" according to aspects of the present disclosure. The registration sensor 120 may be an example of a "second sensor" according to aspects of the present disclosure. The controller 130 may be an example of a "controller" according to aspects of the present disclosure. The guide member 18 may be an example of a "guide member" according to aspects of the present disclosure. The inclined wall 74 may be an example of a "guide section" according to aspects of the present disclosure. The pendulum gear mechanism 93 of the driving force transmission mechanism 80 may be an example of a "switcher" according to aspects of the present disclosure. The operation panel 14 may be an example of a "notification provider" according to aspects of the present disclosure.

What is claimed is:

1. A sheet feeder comprising:

a tray having a supporter configured to support a sheet placed on the tray;

a roller disposed in a position contactable with the supporter, the roller being configured to, when rotating in a particular direction, feed the sheet supported by the supporter, in a conveyance direction along a conveyance path;

a motor configured to generate a driving force to rotate the roller in the particular direction;

a first sensor configured to detect a rotational quantity of the roller;

a second sensor configured to detect that the sheet reaches a particular position on the conveyance path; and a controller configured to perform a particular process comprising:

a driving process comprising:

supplying the motor with an electric current;

a stopping process comprising:

in response to determining that the motor has not rotated before the second sensor detects that the sheet reaches the particular position, stopping supplying the electric current to the motor;

a setting process comprising:

when an accumulated rotational quantity of the roller is less than a threshold, setting a retry upper limit to a first value, wherein the accumulated rotational quantity is detected by the first sensor in the driving process performed for a first time after a beginning of the particular process, and the first value is equal to or more than one; and when the accumulated rotational quantity of the roller is equal to or more than the threshold, setting the retry upper limit to a second value more than the first value; and repeatedly performing the driving process and the stopping process until a number of retries to perform the driving process reaches the retry upper limit or until the second sensor detects that the sheet reaches the particular position.

2. The sheet feeder according to claim 1, wherein the particular process further comprises:

again performing the setting process in response to determining that the motor has not rotated in the driving process executed for a second or subsequent time after the beginning of the particular process and that the retry upper limit is the first value.

3. The sheet feeder according to claim 1, further comprising a guide member configured to define at least a part of an outer side of a curved section of the conveyance path, the curved section being curved along the conveyance direction.

4. The sheet feeder according to claim 1, wherein the conveyance path extends in a direction intersecting a supporting surface of the supporter, and wherein the sheet feeder further comprises a guide section disposed between the conveyance path and a downstream end of the supporter in the conveyance direction, the guide section being configured to come into contact with a leading end of the sheet fed by the roller and to guide the sheet into the conveyance path.

5. The sheet feeder according to claim 1, wherein the supporter is further configured to make a rotational resistance of the roller rotating in contact with the supporter greater than a rotational resistance of the roller rotating in contact with the sheet supported by the supporter.

6. The sheet feeder according to claim 1, wherein the particular process further comprises:

performing the driving process for the first time in response to receipt of a sheet feeding instruction; and performing the setting process only when the sheet feeding instruction includes an instruction to feed a glossy paper.

7. The sheet feeder according to claim 1, further comprising a switcher switchable between:

a transmission state where the switcher transmits the driving force generated by the motor to the roller; and a non-transmission state where the switcher does not transmit the driving force generated by the motor to the roller, wherein the particular process further comprises:

switching the switcher into the non-transmission state from the transmission state, after the stopping process and before the driving process to be next performed.

8. The sheet feeder according to claim 1, wherein the particular process further comprises:

in response to the rotational quantity of the roller detected by the first sensor having continued to be zero during a threshold period of time, determining that the motor has not rotated.

9. The sheet feeder according to claim 1, wherein the driving process of the particular process further comprises:

in response to a rotational speed of the motor being lower than a target speed, increasing an electric current to be supplied to the motor; and in response to the rotational speed of the motor being higher than the target speed, decreasing the electric current to be supplied to the motor, and wherein the particular process further comprises:

in response to having continued to supply a maximum current during a threshold period of time, determining that the motor has not rotated.

10. The sheet feeder according to claim 1, further comprising a notification provider, wherein the particular process further comprises:

in response to the number of retries reaching the retry upper limit, controlling the notification provider to provide a notification that the sheet has not reached the particular position.

11. The sheet feeder according to claim 1, wherein the controller comprises:

a processor; and a memory storing processor-executable instructions configured to, when executed by the processor, cause the processor to perform the particular process.

12. An image recording apparatus comprising:

the sheet feeder according to claim 1;

a conveyance roller disposed downstream of the particular position in the conveyance direction, the conveyance roller being configured to convey the sheet in the conveyance direction; and an image recorder disposed downstream of the conveyance roller in the conveyance direction, the image recorder being configured to record an image on the sheet, wherein the particular process further comprises:

in response to the second sensor detecting that the sheet reaches the particular position, controlling the conveyance roller to convey the sheet to a specific position to face the image recorder; and controlling the image recorder to record an image on the sheet conveyed by the conveyance roller to the specific position.

13. A non-transitory computer-readable medium storing computer-readable instructions that are executable by a processor coupled with a sheet feeder, the sheet feeder comprising:

a tray having a supporter configured to support a sheet placed on the tray;

a roller disposed in a position contactable with the supporter, the roller being configured to, when rotating in a particular direction, feed the sheet supported by the supporter, in a conveyance direction along a conveyance path;

a motor configured to generate a driving force to rotate the roller in the particular direction;

a first sensor configured to detect a rotational quantity of the roller; and a second sensor configured to detect that the sheet reaches a particular position on the conveyance path, the instructions being configured to, when executed by the processor, cause the processor to perform a particular process comprising:

a driving process comprising:

supplying the motor with an electric current;

a stopping process comprising:

in response to determining that the motor has not rotated before the second sensor detects that the sheet reaches the particular position, stopping supplying the electric current to the motor;

a setting process comprising:

when an accumulated rotational quantity of the roller is less than a threshold, setting a retry upper limit to a first value, wherein the accumulated rotational quantity is detected by the first sensor in the driving process performed for a first time after a beginning of the particular process, and the first value is equal to or more than one; and when the accumulated rotational quantity of the roller is equal to or more than the threshold, setting the retry upper limit to a second value more than the first value; and repeatedly performing the driving process and the stopping process until a number of retries to perform the driving process reaches the retry upper limit or until the second sensor detects that the sheet reaches the particular position.

* * * * *